US006782810B2

(12) United States Patent
Vilo

(10) Patent No.: US 6,782,810 B2
(45) Date of Patent: Aug. 31, 2004

(54) CONTINUOUS PRESS

(75) Inventor: Jaakko Vilo, Nastola (FI)

(73) Assignee: Raute Oyj (FI)

( * ) Notice: Subject to any disclaimer, the term of this patent is extended or adjusted under 35 U.S.C. 154(b) by 0 days.

(21) Appl. No.: 10/300,769

(22) Filed: Nov. 21, 2002

(65) Prior Publication Data

US 2003/0094105 A1 May 22, 2003

(30) Foreign Application Priority Data

Nov. 21, 2001 (FI) ..... 20012269

(51) Int. Cl.[7] ..... B30B 5/04

(52) U.S. Cl. ..... 100/151; 100/154; 100/178; 100/295; 100/296

(58) Field of Search ..... 100/151, 153, 100/154, 210, 177, 178, 295, 296, 306, 311, 144

(56) References Cited

U.S. PATENT DOCUMENTS 4,025,272 A * 5/1977 Camp, III ..... 425/324.1
4,285,373 A * 8/1981 Buchanan ..... 144/2.1
4,466,857 A * 8/1984 Pfeiffer ..... 156/583.5
5,493,961 A * 2/1996 Gerhardt et al. ..... 100/50
5,592,874 A * 1/1997 Blauhut ..... 100/311
5,791,239 A * 8/1998 Lauderbaugh et al. ..... 100/48
6,439,113 B1 * 8/2002 Gawlitta et al. ..... 100/38

* cited by examiner

*Primary Examiner*—Ed Tolan
(74) *Attorney, Agent, or Firm*—Connolly, Bove, Lodge & Hutz LLP

(57) ABSTRACT

The invention relates to a continuously operating press for pressing planar products. The press comprises facing platens (7, 7') between which the product (1) to be pressed is passed in order to subject the same to compression. The press further includes slat elements (2, 2') introduced as a continuous line of adjacent slat elements between the product (1) being pressed and both ones of the press platens (7, 7') so as to make the slats to travel with the product being pressed and to slide along the press platens, the surface of the slats facing the platens being provided with a tray recess. The press platens are provided with pressurized-medium ducts whose ends exit at the platen surface facing the recessed surface of the slats and whose mutual duct-to-duct spacing between their exit openings in the operating direction of the press is selected to connect the slats to a pressurized-medium source when the openings coincide with the tray recess while the connection is interrupted at the tray recess boundary ridge areas of successive slats.

9 Claims, 1 Drawing Sheet

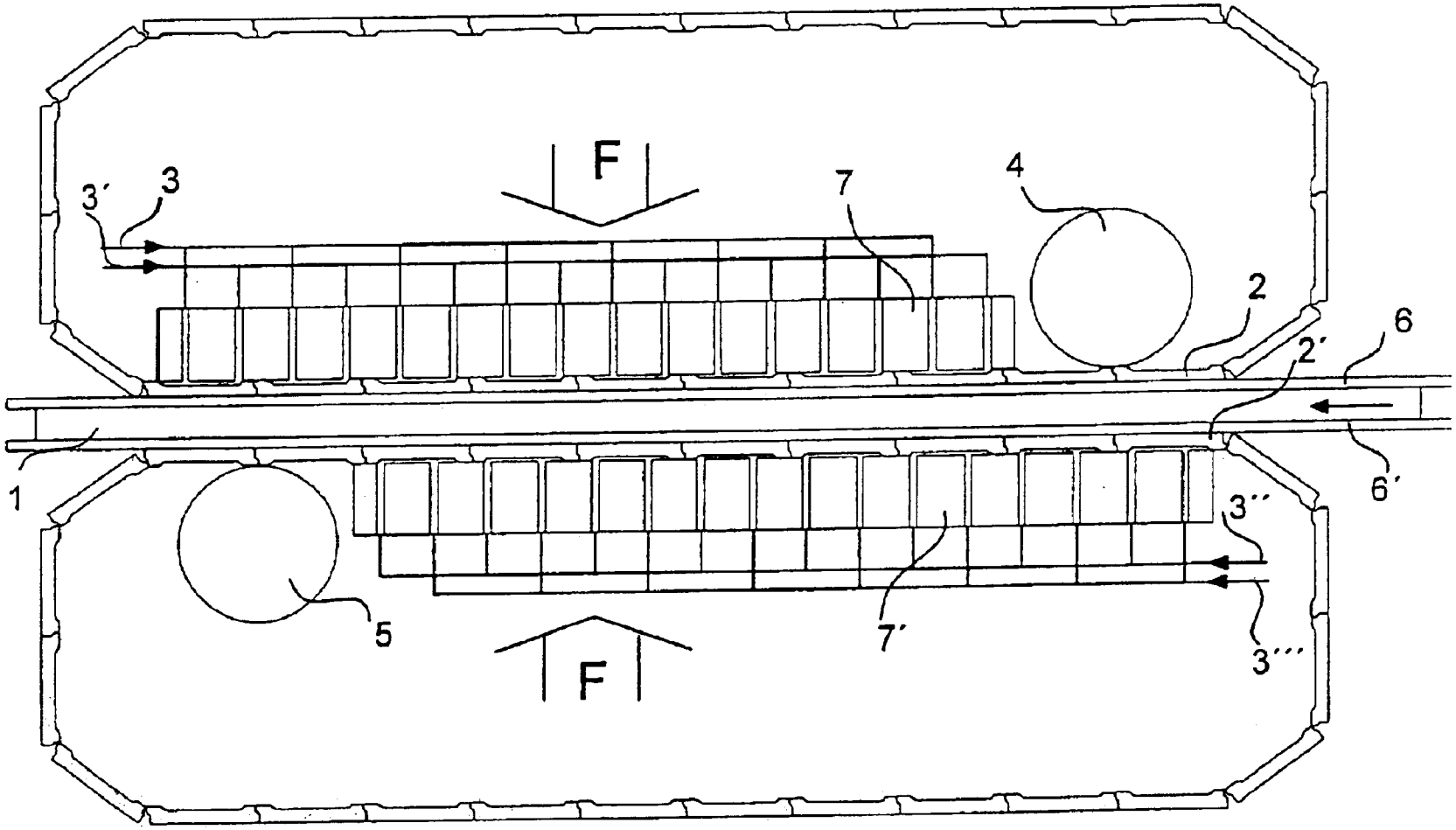
6
6'
2'
2
3''
3'''
4
7
7'
F
F
5
3
3'
1

CONTINUOUS PRESS

The invention relates to a continuously operating press for pressing planar products. In particular, the press is suited for use in the production of laminated wood products such as beams of the so-called laminated veneer lumber type (LVL beam) made by adhering to each other a layout of parallel strands of wood. In these presses, the product is passed under pressure directed thereon by two facing press means forming a press gap. During the pressing step, generally also heat is imposed on the product in order to promote the curing of the glue applied to the product layup.

Continuous presses of this type used in the art are generally implemented using a construction wherein the product to be pressed is passed into a gap formed between two opposed metal belts arranged to run continuously in endless loops, both of which having in one portion of their run adapted a compressing section in which the faces of the product are subjected to a compressing pressure. The compressing pressure is applied by means of platens adapted to operate in the interior of the belt loops. Between the platen and the press belt are placed metallic rod-like rollers running under a control, and transmitting the compressing pressure from the platens to the press belt and, if so desired, also heat from heatable platens. This kind of construction subjects the press belt to lineal forces that impose local stresses on both the belt and the rollers loading the same. Further, the press belt must exhibit a given degree of stiffness so that the compressing pressure will extend also to the marginal areas of the belt not covered by the lineal contact of the rollers. The construction is also limited as to its heat transfer capability that in practice is curtailed to conductive heat transmission via the rollers.

The press construction according to the invention makes now possible to impose the compressing pressure on the product in a substantially uniform fashion over the entire surface of the product while simultaneously the compressing force is distributed substantially equally over the belt surface. Resultingly, the strength specifications of the belt used in the press are relaxed as compared with the prior art. Hence, the press belt may be replaced with an element of a material different from a metallic belt. Also the efficiency of thermal transmission between the press platens and the product can be improved. In certain applications it is even possible to omit the belt entirely from the press construction.

The invention is implemented in a continuously operating press comprising facing platens between which the product to be pressed is passed in order to subject the same to compression, the press is provided with slats introduced as a continuous line of adjacent slat elements between the product being pressed and both ones of the press platens so as to make the slats to travel with the product being pressed and to slide along the press platens, whereby the surface of the slats facing the platens is provided with a tray recess, at least one of the press platens is provided with pressurized-medium ducts whose mutual duct-to-duct spacing between their exit openings in the operating direction of the press is greater than the summed width dimension in the press operating direction across the tray recess boundary ridge areas of two successive slats, but yet is smaller than the edge-to-edge internal width of a single tray recess in the same operating direction, and further that each duct communicates with a pressurized-medium source different from that supplying the duct located immediately preceding or, respectively, following said duct in the operating direction of the press. Other characterizing features of the invention will be evident from the dependent claims appended to this application.

The construction of the press according to the invention is illustrated in appended drawing wherein the press is shown schematically in a longitudinally sectional view.

Now referring to the FIGURE, in the embodiment shown therein a product 1 to be pressed is passed into the gap of the continuously operating press formed by press belts 6 and 6'. To accomplish the compressing pressure to be imposed on the product, the press is provided in a conventional fashion with two opposedly operating platens 7 and 7' that define the gap of the press. In addition to these basic elements, the press construction further includes planar slats 2 and 2' that are introduced in a succession tightly adjacent with one another between the press belts 6 and 6' and their respective platens 7 and 7'. Slats 2 and 2' travel along with the press belts slidably resting on the surfaces of the platens. In each one of the slats, the face intended to rest against the surface of the press platen is provided with a tray recess that extends over a substantial area of the slat surface yet leaving an unrecessed boundary ridge to surround the tray recess made on the slat. Thus, when the slat tightly faces the compressing surface of the press platen, a closed space is formed by the tray recess between the slat and the press platen. This space can be adapted to communicate with a pressurized-medium source via ducts made through the bodies of the press platens. In a sequence to be explained below, into this closed space from the pressurized source is then passed a pressurized medium, water in particular, whereby the pressurized medium forms between the slats and the press platens a load-transmitting padding while the pressurized medium simultaneously acts as lubricant of the sliding motion.

In the operating direction of the press, the ducts are located in a succession along the operating direction of the press so that the spacing between two successive ducts in the operating direction of the press is smaller than the edge-to-edge internal width of a single tray recess but yet the spacing is large enough to span a distance larger than the summed width dimension across the tray recess boundary ridge areas of two successive slats. Every second one of the ducts communicates with a first pressurized-medium source 3, 3", while respectively every other second one communicates with a second pressurized-medium source 3', 3'". Then, the press can be operated by way of appropriately controlling the pressurized-medium sources so that those ducts coinciding at a given instant with the boundary ridge areas adjacent to each other in the abutting slats are not pressurized, while the ducts opening into the tray recesses of the compressing slats are respectively pressurized. An alternative method of operating the press is that all the ducts 3, 3', 3", 3'" exiting on any one of the slats moving at a given instant within the central compressing portion of the press are held pressurized, which is possible if the press construction within this portion thereof does not exhibit a substantial leakage rate of the pressurized medium. The pressurized-medium ducts may also be grouped so that the ducts exiting on the incoming portion, central portion and outgoing portion of the press are respectively arranged to communicate with dedicated pressurized-medium sources in order to subject the product to different compressing pressures at different portions of the press.

Using a heated pressurized medium makes it possible to employ the same for convective transfer of heat to and via the slats to the product being pressed.

The slats 2 and 2' are made from a suitable material which advantageously is metallic. Advantageously, the slats abut each other in a hinged fashion, whereby they can be circulated along an endless-loop track as shown in the appended diagram.

To ease the burden of the press drive system and reduce wear thereof, suitable low-friction surface materials are advantageously used on the facing surfaces of the press platens 7 and 7' and, respectively, the slats 2 and 2' or, alternatively, as desired on either one of the sliding surfaces.

In the embodiment shown in the diagram, the start and end points, respectively, of the operating zones of press platens 7 and 7' are staggered in the travel direction of the product. This arrangement makes it easier to introduce the slats 2 and 2' into the gap of the press and, respectively, to gain easier exit of the slats at the outgoing end of the press. In the embodiment illustrated herein, the upper press platen 7 is displaced downstream relative to the lower press platen 7' in the travel direction of the product, whereby the introduction of slats 2 is implemented with the help of a roll 4 mounted in front of the upper press platen. In lieu of a roll, also hydraulic cylinders may be used herein. At the outgoing end of the press is respectively mounted a roll 5 serving to aid the exit of slats from the press gap.

The progressive movement of the product and the slats is accomplished by applying a pushing force on the slats at their entry. Their travel speed can be controlled by applying a retarding force where the slats leave the press gap. Alternatively, the slat travel speed may be controlled by adjusting the entry speed of the slats.

What is claimed is:

1. A continuously operating press for pressing planar products, the press comprising:

two platens each having a platen surface facing a product being passed between said platens and arranged to subject said product to compression; and slat elements each having a slat surface, wherein said slat elements are arranged as a continuous line of adjacent slat elements between said product and each of said press platens so as to cause said slat elements to travel with said product, wherein said slat surface is in sliding contact with a respective platen surface, wherein said slat surface includes a tray recess surrounded by boundary ridges and having an edge-to-edge internal width in a traveling direction of said slat elements, wherein at least one of said press platens is provided with pressurized-medium ducts having ends exiting at said platen surface of a respective platen, wherein said ends have a mutual spacing in said traveling direction greater than a summed width dimension across the tray recess boundary ridge areas of two successive slat elements, yet smaller than said edge-to-edge internal width, and wherein each of said ducts communicates with a pressurized-medium source different from a pressurized-medium source supplying an immediately proceeding or immediately following duct in said traveling direction.

2. The press of claim 1, wherein a duct preceding a given duct in said traveling direction and a duct exiting after said given duct in said traveling direction communicate with the same pressurized-medium source.

3. The press of claim 1, wherein in said pressurized-medium source is a hydraulic fluid source.

4. The press of claim 3, wherein said pressurized-medium source is a pressurized-water source.

5. The press of claim 3, wherein said pressurized medium is at an elevated temperature.

6. The press of claim 1, wherein said platen surfaces are coated with a low-friction material.

7. The press of claim 1, wherein said boundary ridges of said slat elements are coated with a low-friction material.

8. The press of claim 1, wherein said slat elements are circulated along an endless-loop track.

9. The press of claim 1, further comprising a gasket strip adapted to run in an interface between the product being pressed and the slat elements.

* * * * *